US006533190B1

(12) United States Patent
Wang

(10) Patent No.: US 6,533,190 B1
(45) Date of Patent: Mar. 18, 2003

(54) SPRAYER HAVING 3 DIMENSIONAL WATER SCREEN

(76) Inventor: Yu-Tzu Wang, 21F-3, No. 189, Sec. 2, Keelung Rd., Taipei (TW)

( * ) Notice: Subject to any disclaimer, the term of this patent is extended or adjusted under 35 U.S.C. 154(b) by 0 days.

(21) Appl. No.: 09/938,603

(22) Filed: Aug. 27, 2001

(51) Int. Cl.[7] ..... B05B 17/08

(52) U.S. Cl. ..... 239/17; 239/273; 239/276; 239/261

(58) Field of Search ..... 239/16–19, 211, 239/225.1, 246, 251, 261, 264, 265, 273, 276

(56) References Cited

U.S. PATENT DOCUMENTS 1,790,732 A * 2/1931 Tichava ..... 239/246
6,015,098 A * 1/2000 Krueger ..... 239/261
6,109,546 A * 8/2000 Ormiston ..... 239/245
6,202,937 B1 * 3/2001 King ..... 239/17

* cited by examiner

*Primary Examiner*—Lisa A. Douglas
(74) *Attorney, Agent, or Firm*—Bacon & Thomas, PLLC

(57) ABSTRACT

A sprayer. An annular tube is installed at a water outlet of a water main tube. The annular tube is installed with spraying holes. The annular tube is formed with at least one annular tube. The surface of the annular tube is installed with spraying holes. In one embodiment, a first annular tube rotates around the water main tube. Another annular tube rotates around the first annular tube so that water beams from the spraying holes to present a changeable three dimensional effect.

2 Claims, 6 Drawing Sheets

SPRAYER HAVING 3 DIMENSIONAL WATER SCREEN

FIELD OF THE INVENTION

The present invention relates to a sprayer, wherein a plurality of water outlet joints are connected at the water outlet of the water main tube. The water outlet joints are connected to respective water spraying tubes.

BACKGROUND OF THE INVENTION

For the current sprayer (referring to FIG. 1), the distal end of the water main tube 10 has a joint 11 which is connected to an annular tube 12. The surface of the annular tube 12 is installed with spraying holes 13 (shown in FIG. 2). The annular tube 12 is divided into two parts. The left and right parts of the spraying holes 13 are arranged at opposite sides. If the left side of the spraying hole 13 is on the upper surface of the annular tube 12, and the right side of the spraying hole 13 is on the lower surface of the annular tube 12 (referring to FIG. 2), as water in the annular tube 12 sprays out from the spraying holes 13, by the reaction force of the water beam 14, the annular tube will rotate around the axial center of the water tube 10. This way for arranging spraying holes 13 will generate water beams 14 at opposite directions and thereby, the annular tube 12 will rotate due to the water beams 14.

In this sprayer, the water beam 14 will present as a water screen by the driving of the annular tube. Therefore, a beautiful scenery is formed. However, the conventional sprayer presents a pane or umbrella like water screens. The shape is dull. Even the shape of the annular tube 12 is changed, the water screen has also a two dimensional plane form

SUMMARY OF THE INVENTION

Accordingly, the primary object of the present invention is to provide a sprayer with a three dimensional water screen. The water outlet of the water main tube is installed with an annular tube and at least one tube. The annular tube or tube has joints at two ends. The two ends are connected to a common annular tube, or each joint is connected to an annular tube. Each annular tube or tubes are installed with spraying holes. Therefore, when water flows in the annular tube or tubes, and water is sprayed from the spraying holes. Each tube bodies will be driven to rotate. The rotational direction is different. Therefore, a 3D water screen is presented. The reason is that the annular tube or tubes connected to the water main tube may be driven by water to rotate by itself, so that the tube connected to the aforesaid tube will be driven to rotate by itself, the rotations of the two depend on different axial centers. The former rotates around the water main tube, while the latter rotates around the former tubes. Therefore, the effect likes the rotation of the earth. The two rotates around different centers. Therefore, the 3D water screen is formed. The annular tube or tubes of the present invention may have any desired shape. One water outlet end is further connected to an annular tube. Spraying holes are installed on the surfaces of the annular tubes As in operation, water screen of the annular tube like an envelop, an the water screen from the annular tube presents a special shape. Therefore, the whole effect likes an envelope with one pet therein. The shapes of the annular tubes can be modified as desired.

DETAILED DESCRIPTION OF THE PREFERRED EMBODIMENTS

Figure 1:
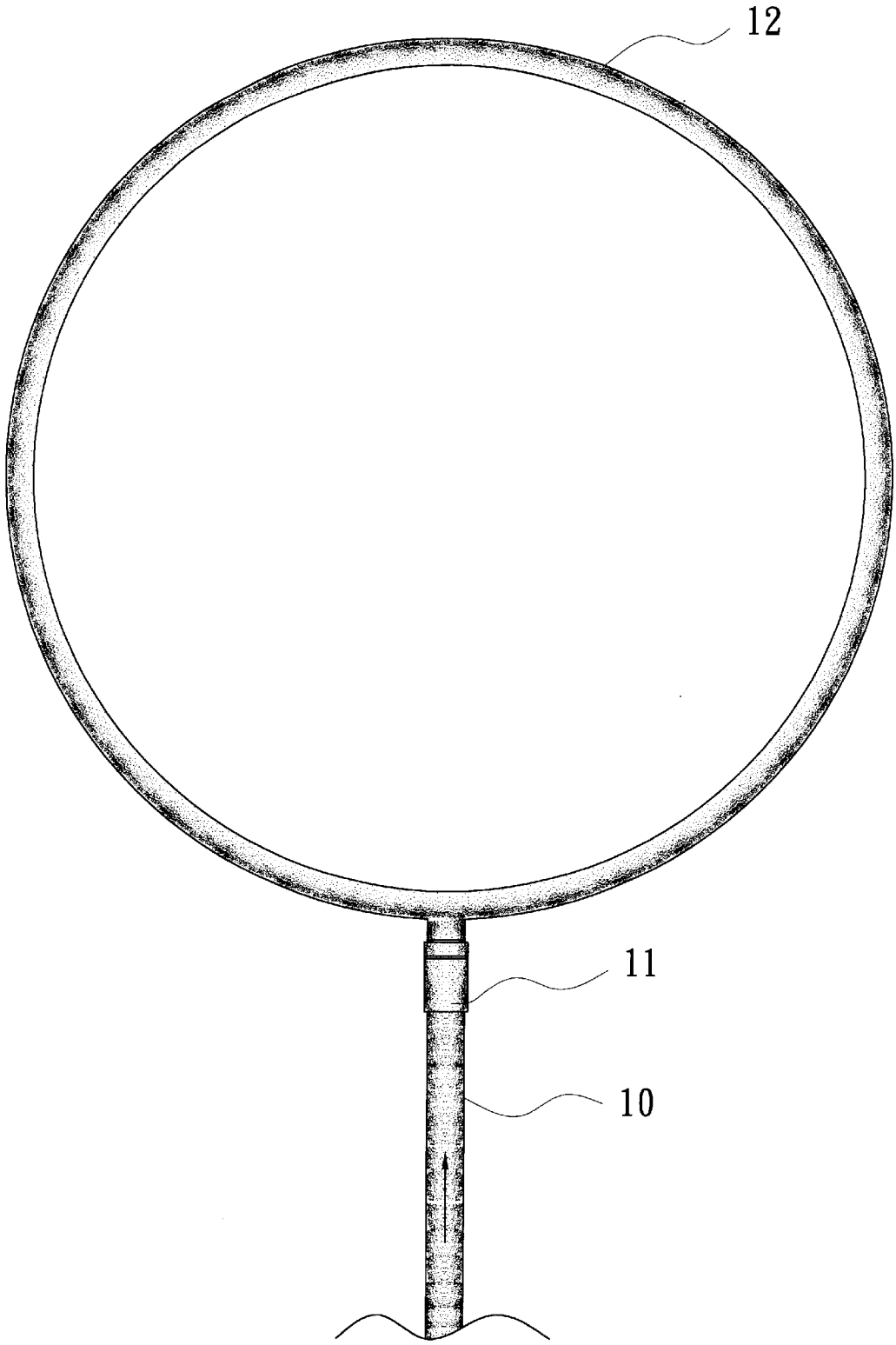
FIG. 1 PRIOR ART
FIG. 1 is a front view of a prior art sprayer.
Figure 2:
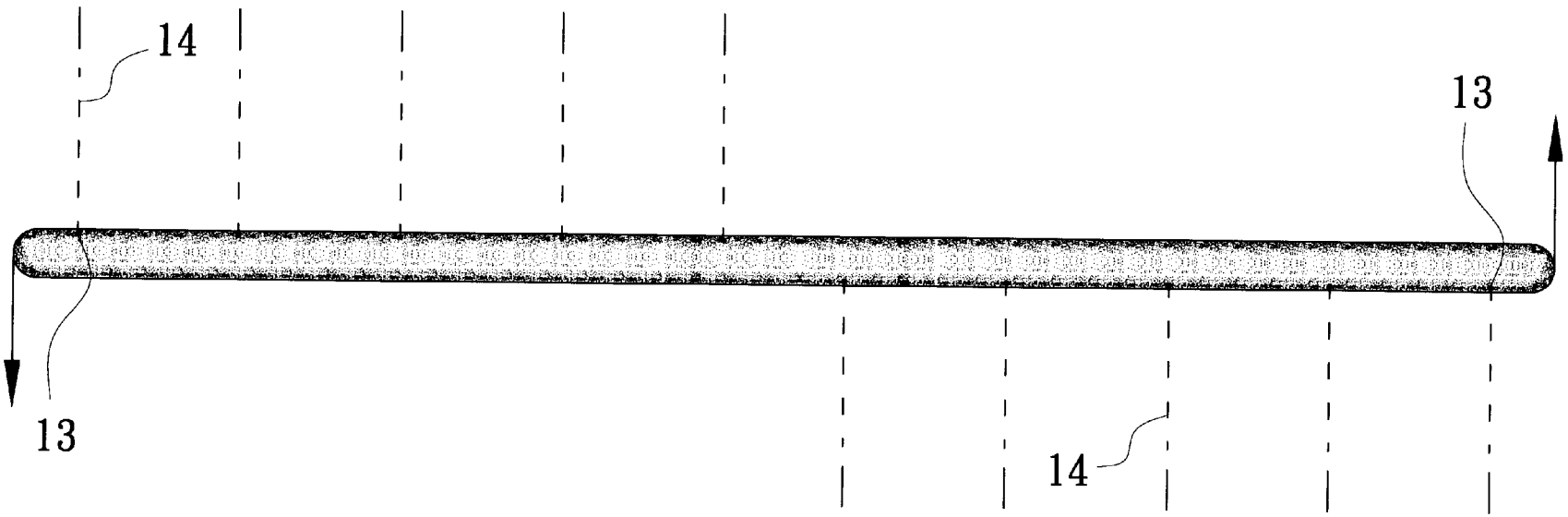
FIG. 2 PRIOR ART
FIG. 2 is a top view of a prior art sprayer.
Figure 3:
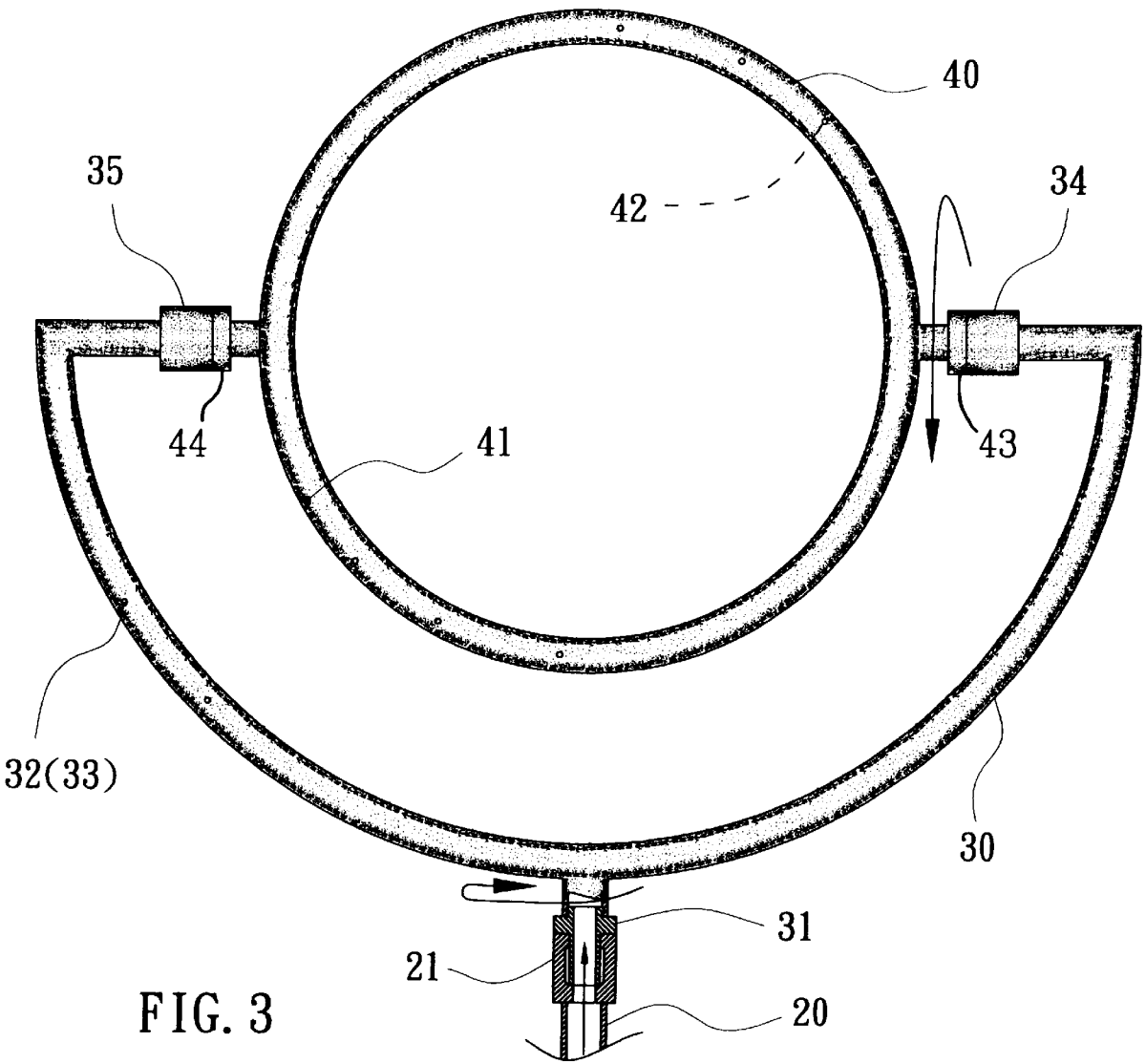
FIG. 3 is a front structural view of the sprayer of the present invention.
Figure 4:
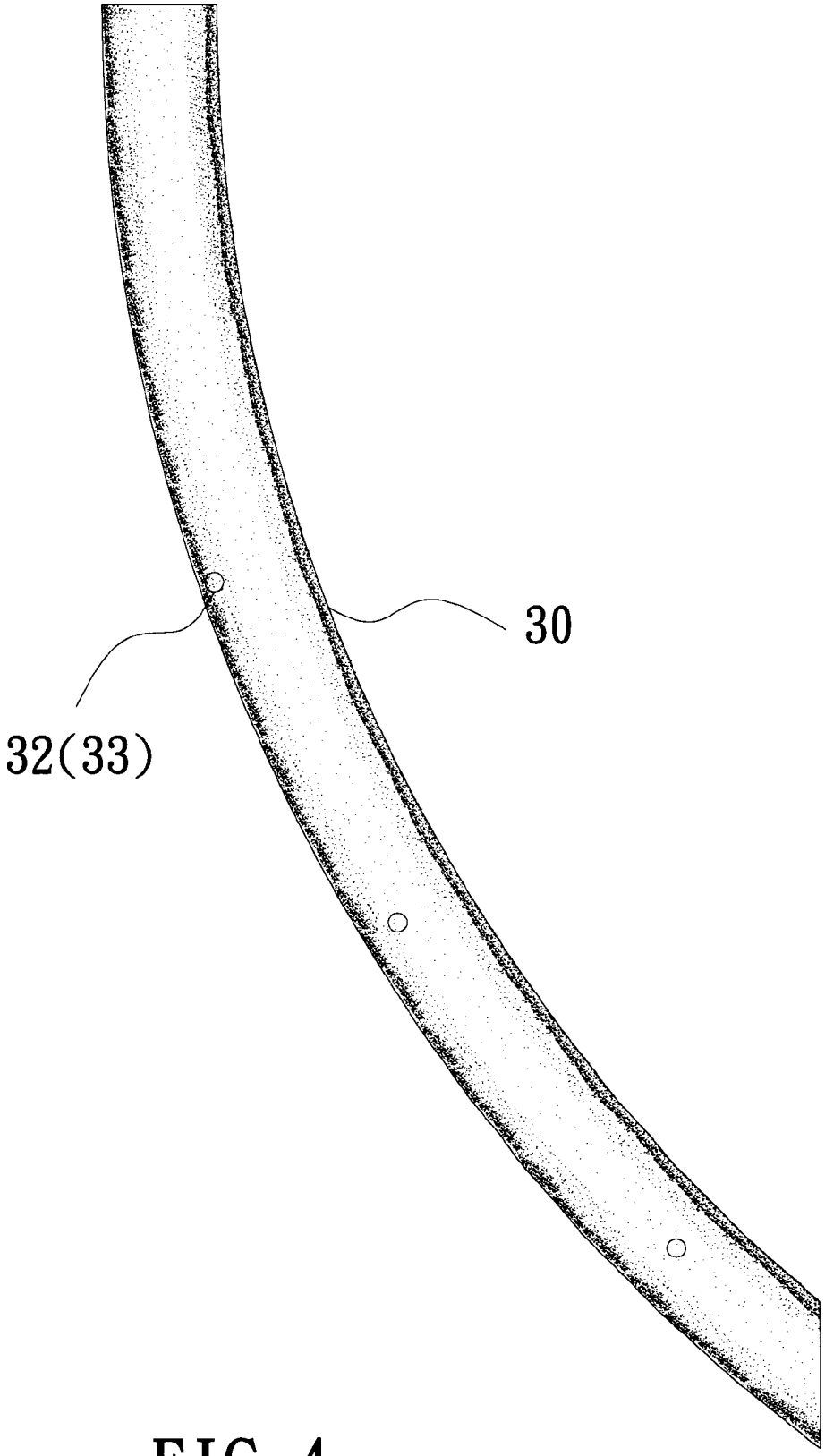
FIG. 4 shows the distribution of the spraying holes of the sprayer according to the present invention.

Referring to FIG. 3, in the present invention, a screw sleeve 21 is installed at one water outlet end of a water main tube 20. A connecting head 31 capable of being engaged with an annular tube 30 is engaged with the sleeve. Water flows through the water main tube 20, the screw sleeve 21 and joint head 31 to the annular tube 30. The surface of the annular tube 30 is installed with spraying holes 32, 33. The left spraying hole 32 is at the surface of the annular tube 30, and the right spraying hole 33 is at a rear side of the annular tube 30. Thereby, as water is sprayed, a torque generates, therefore, the annular tube 30 rotates along the water main tube 20. Besides, the holes of the spraying holes 32, 33 on the annular tube 30 are formed as an approximate parabolic curve (referring to FIG. 4) so that a torque can be generated successfully. Two distal ends of the abovesaid annular tube 30 are installed with two screw sleeves 34 and 35. An annular tube 40 is formed therebetween. The annular tube 40 is formed with spraying holes 41, 42. The two joint heads 43, 44 at two ends are used as fulcrums of the annular tube 40, when water flows through the joint head 43, 44 to the spraying holes 41, 42 and then sprays out, the annular tube 40 can rotate around the axial center between two ends of another annular tube 30. Therefore, since the two annular tubes 30 and 40 rotate around different axial centers, a three dimensional water screen is formed. One or two of the screw sleeves 34 and 35 of the annular tube 30 have water through holes. Thereby, water in the annular tube 30 can flow into another annular tube 40. Furthermore, the joint heads 43, 44 of the annular tube 40 are installed to match the water through holes of the screw sleeves 34 and 35. Thereby, only one of the joint heads is installed with water through hole.

Figure 5:
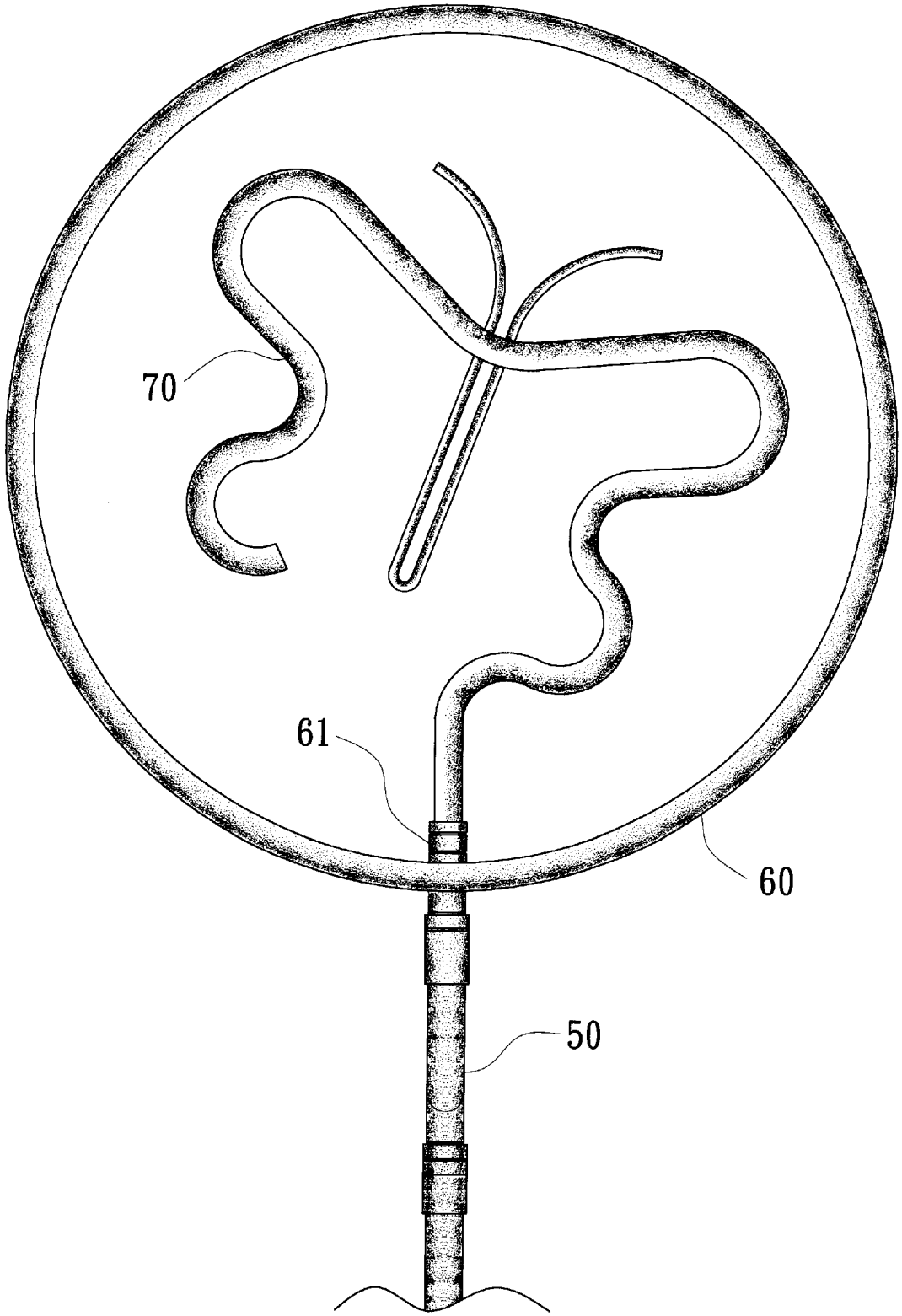
FIG. 5 is a front structural view of another embodiment of the sprayer according to the present invention.
Figure 6:
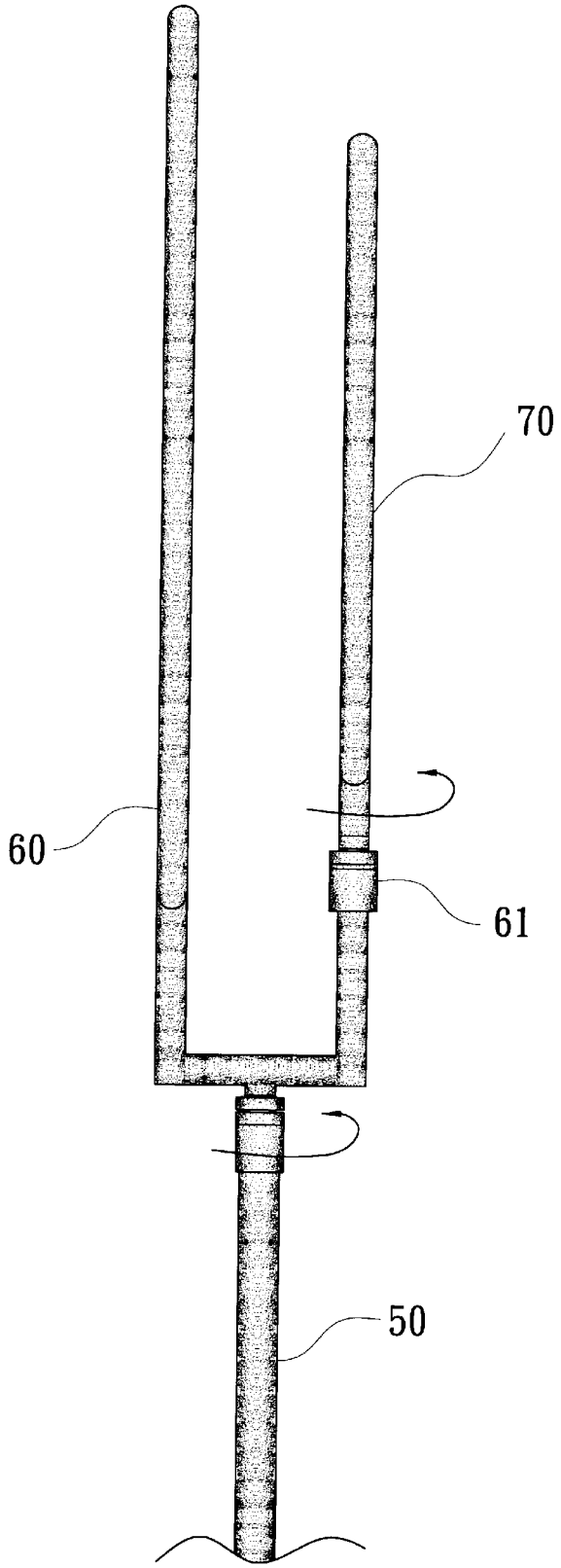
FIG. 6 is a right side view of the present invention.

Referring to FIGS. 5 and 6, another embodiment of the present invention is illustrated. An L shape annular tube 60 is screwed into an upper end of the water main tube 50. One water outlet end 61 is further connected to an annular tube 70. Spraying holes are installed on the surfaces of the annular tubes 60 and 70. As in operation, water screen of the annular tube 60 like an envelope, an the water screen from the annular tube 70 presents a special shape. Therefore, the whole effect likes an envelope with one pet therein. The shapes of the annular tubes 60 and 70 can be modified as desired.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sprayer comprising:

a water main tube having an outlet and a first longitudinal axis;

a first annular tube rotatively secured to the water main tube, the first annular tube including a plurality of first spraying holes configured such that when liquid enters the first annular tube from the outlet of the water main tube, liquid exits the first spraying holes thereby rotating the first annular tube along the first longitudinal axis; and a second annular tube comprising a plurality of second spraying holes rotatively connected to the first annular tube at a second longitudinal axis and in communication with the water main tube via the first annular tube, such that liquid from the water main tube enters the second annular tube from the first annular tube and exits through the second spraying holes of the second annular tube thereby rotating the second annular tube along the second longitudinal axis which is different from that of the first longitudinal axis.

2. The sprayer as claimed in claim 1, wherein positions of the spraying holes are arranged having a cambered shape.

* * * * *